US006474443B2

(12) United States Patent
Kearns et al.

(10) Patent No.: US 6,474,443 B2
(45) Date of Patent: Nov. 5, 2002

(54) PORTABLE SUCTION DEVICE FOR REMOVAL OF FUEL/OIL FROM AN ENGINE

(75) Inventors: Barry A. Kearns, Scotts, MI (US); Curtis Taylor, Moreland Hills, OH (US)

(73) Assignee: Kristus, Inc., Scotts, MI (US)

( * ) Notice: Subject to any disclaimer, the term of this patent is extended or adjusted under 35 U.S.C. 154(b) by 0 days.

(21) Appl. No.: 09/875,112

(22) Filed: Jun. 6, 2001

(65) Prior Publication Data

US 2001/0050199 A1 Dec. 13, 2001

Related U.S. Application Data

(60) Provisional application No. 60/209,940, filed on Jun. 7, 2000.

(51) Int. Cl.[7] ..... F16C 3/14; F16N 33/00

(52) U.S. Cl. ..... 184/1.5; 137/205; 222/469; 222/471; 141/65; 141/231

(58) Field of Search ..... 184/1.5, 28, 58, 184/64; 137/205; 141/65, 230, 231; 222/631, 205, 323, 465.1, 469, 471

(56) References Cited

U.S. PATENT DOCUMENTS 4,378,026 A * 3/1983 Bauer ..... 137/205
4,548,088 A * 10/1985 Hood, Jr. ..... 137/205
5,002,154 A 3/1991 Chen
5,375,703 A * 12/1994 Deuber ..... 141/98
5,435,413 A * 7/1995 Schoenborn ..... 134/169 A
5,450,924 A 9/1995 Tseng
5,454,960 A * 10/1995 Newsom ..... 123/196 A
6,003,635 A * 12/1999 Bantz et al. ..... 184/1.5
6,102,159 A * 8/2000 Rogate ..... 123/196 R

OTHER PUBLICATIONS

Boat US–store.com, "Engine Shop Lubrication Oil Changing/Transfer Pumps", 5 pgs., May 18, 1999.
Overton's Online–Product Detail, "Online Catalog" 2 pgs., May 18, 1999.
Griotsgarage.com, "Oil Changes" 1 page, May 18, 1999.
"Topsider MVP Multi–purpose Vacuum Pump" Feb., 2000 2 pgs.

* cited by examiner

*Primary Examiner*—David Fenstermacher
(74) *Attorney, Agent, or Firm*—Flynn, Thiel, Boutell & Tanis, P.C.

(57) ABSTRACT

A portable suction device for removing liquid from an engine includes a plastic tank including a pump aperture for enabling removal of air or gases from the tank and a receiving aperture for receiving a liquid or gas from an engine. The suction device includes a pump apparatus for creating a negative pressure in the plastic tank. The pump apparatus includes a metal cylindrical tube, a plastic piston surrounded by the cylindrical tube, a metal piston rod having an end secured to the piston and a pump handle secured to the other end of the piston rod. A plastic support bracket supports a first end of the cylindrical tube adjacent the pump handle by securing the tube to a protrusion at a top end of the tank. A pump support cap receives the second end of the cylindrical tube for securing the tube at the pump aperture of the plastic tank. Due to the arrangement of the cylindrical tube above the plastic tank, the cylindrical tube functions as a portable suction device handle for carrying the plastic tank.

20 Claims, 3 Drawing Sheets

PORTABLE SUCTION DEVICE FOR REMOVAL OF FUEL/OIL FROM AN ENGINE

CROSS REFERENCE TO RELATED APPLICATION

This application claims priority from Provisional Application No. 60/209,940 filed June 7, 2000, titled "PORTABLE SUCTION DEVICE FOR REMOVAL OF FUEL/OIL FROM AN ENGINE".

FIELD OF THE INVENTION

This invention relates to a compact portable pump device for extracting liquid from an engine, and more particularly, for extracting gasoline, transmission oil, diesel fuel or motor oil from an engine.

BACKGROUND OF THE INVENTION

The use of a portable oil suction device for removing oil from engines is well known. For example, U.S. Pat. No. 5 450 924 to Tseng discloses such a suction device including a pump cylinder surrounded by an oil tank. Tseng also discloses a carrying handle at the top of the device shaped to receive the handle of the suction pump.

It is an object of this invention to provide an improved oil suction device having a portable and easy to carry arrangement than the known devices. Such a result can be obtained by providing a vacuum pump apparatus including a cylindrical tube acting as a handle for the suction device. This arrangement enables the pump apparatus to have two functions, thus reducing the size and increasing the ease of carrying the portable suction device.

Another object of the invention is to provide a unique suction pump apparatus arrangement including support means supporting first and second ends of the cylindrical tube of the pump apparatus, the pump apparatus creating a negative pressure in a plastic tank during an outward stroke of the piston of the pump apparatus.

SUMMARY OF THE INVENTION

The objects and purposes of this invention have been met by a portable suction device for removing liquid from an engine including a plastic tank having an integral protrusion extending upwardly from the tank, a pump aperture for enabling removal of gas or air from the tank and a receiving aperture for receiving a liquid or gas from an engine. The device includes a pump apparatus for creating a negative pressure in the plastic tank. The pump apparatus includes a cylindrical tube, a piston surrounded by the tube, a piston rod having a first end extending outwardly beyond a first end of the cylindrical tube and secured at a second end to the piston, a leather element extending about at least a portion of a peripheral edge of the piston, and a pump handle at the first end of the piston rod for enabling movement of the piston rod along a length of the cylindrical tube. A plastic support bracket mounts to the protrusion of the plastic tank and supports the first end of the cylindrical tube adjacent the pump handle and a pump support cap receives the second end of the cylindrical tube and secures the cylindrical tube at the pump aperture of the plastic tank. The plastic support bracket and the pump support cap enable the cylindrical tube to function as a handle for carrying the plastic tank. A metal closure element including a check valve to enable creation of negative pressure in the plastic tank is also positioned between an inward face of the pump support cap and an end face of the tank about the pump aperture for substantially closing the pump aperture.

In one embodiment, the plastic support bracket includes a cylindrical cup-shape for receiving and supporting the first end of the cylindrical tube and an aperture along a central axis for enabling travel of the piston rod therethrough.

In another embodiment, the pump apparatus includes a piston end piece having an extension for securing the leather element to the piston.

In yet another embodiment, the piston rod is metal, and the piston, and piston end piece are a plastic material.

In still further embodiments, the piston valve member is a leather element soaked in oil and extending about at least a portion of an outer flat surface of the piston as well as the peripheral edge of the piston, and includes an aperture to enable the extension of the piston end piece to pass therethrough and secure the disk to the piston.

In the most preferred embodiment, the cylindrical tube of the pump apparatus is mounted by support means so the longitudinal axis thereof is substantially horizontal when the tank is placed on a horizontal surface.

In the most preferred embodiment, the piston and tank are made from a plastic material. The cylindrical tube is made from a metal material providing contrasting electrical conductivity. The large metal surface area of the tube, as well as the varying conductivity of the materials, dissipates (substantially reduces) static charge among the piston, tube and tank.

BRIEF DESCRIPTION OF THE DRAWINGS

Other objects and purposes of the invention will be apparent to persons acquainted with an apparatus of this general type upon reading the following specification and inspecting the accompanying drawings, in which.

Figure 1:
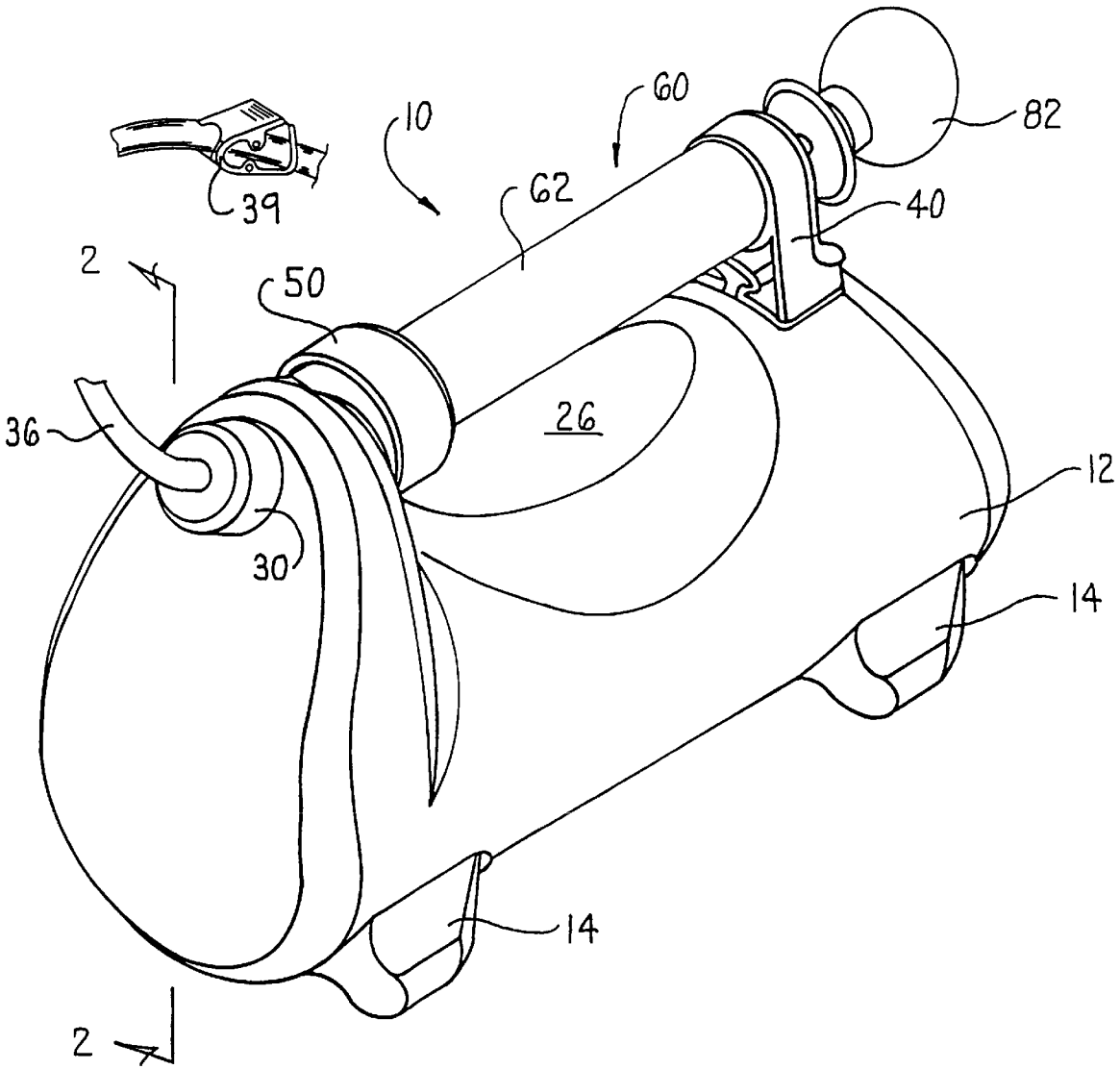
FIG. 1 is a perspective view of the portable suction device embodying the invention.

Be Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the portable suction device and designated parts thereof. Such terminology will include the words specifically mentioned, derivatives thereof, and words of similar import.

DETAILED DESCRIPTION OF THE INVENTION

Referring to the drawings and specifically to FIG. 1, there is illustrated a portable suction device 10 including a plastic tank 12 having four spaced legs 14 extending downwardly from the body thereof. The legs 14 support and balance the plastic tank 12 to prevent tipping thereof. The plastic tank 12 also has a thick wall construction to prevent implosion of the tank.

Figure 2:
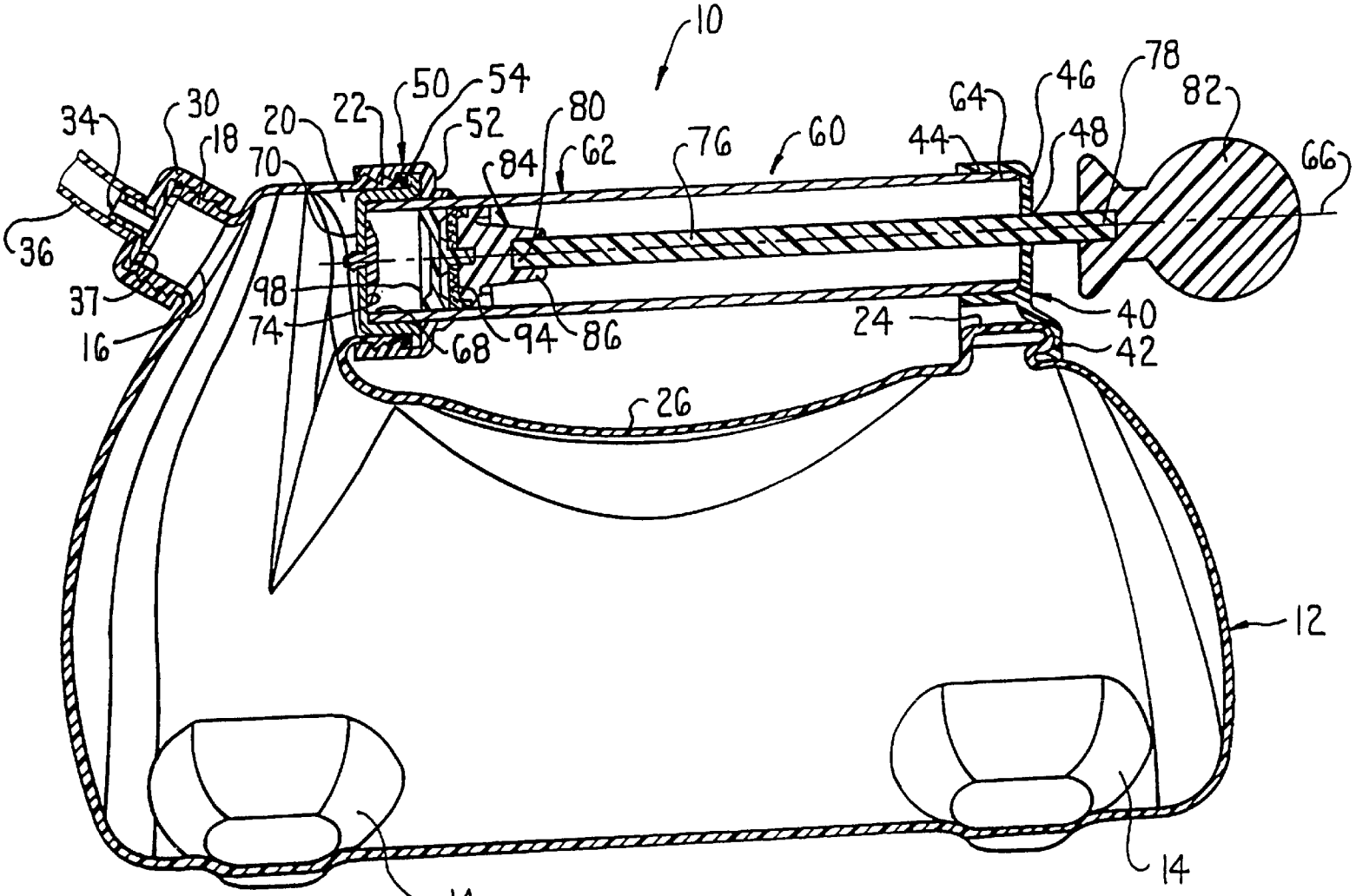
FIG. 2 is a cross-sectional view of the portable suction device taken at II—II in FIG. 1.

Plastic tank 12 includes a receiving aperture 16, as shown in FIG. 2, formed near the top on an end of the tank. The receiving aperture 16 has a generally cylindrical shape. An externally threaded cylindrical receiving inlet or nozzle 18 preferably integral with the plastic tank 12 extends outwardly therefrom and forms the receiving aperture 16. The receiving inlet 18 forms a wall extending outwardly from the tank 12.

Plastic tank 12 also includes a pump aperture 20 formed inside an externally threaded pump outlet 22 preferably integral with and extending from the plastic tank 12 as shown in FIG. 2. The pump outlet 22 is positioned adjacent, but projects in a direction generally opposite from, the receiving inlet 18. However, the pump outlet 22 opens inwardly toward the center of a top portion of the portable suction device 10. In this way, the pump aperture 20 enables flow of air out of the plastic tank 12 to create a negative pressure therein and will not receive a liquid stored in the tank unless the tank is overfilled.

A protrusion 24 integral with the plastic tank 12 extends upwardly at an opposing top end of the tank from the receiving inlet 18. The protrusion 24 is shaped to receive a support bracket 40 as discussed below.

A generally shallow concave depression 26 in the plastic tank 12 is located at a top middle portion thereof.

The plastic tank 12 including the legs 14, receiving inlet 18, pump outlet 22 and protrusion 24 is formed from a plastic material, for example polyethylene or the like.

The portable suction device 10 also includes an internally threaded receiving cap 30. The receiving cap has a central opening enabling an adapter piece 32 to project outwardly and upwardly from one side thereof. The adapter piece 32 includes an adapter piece opening or aperture 34. The adapter piece 32 can receive a hose 36. The hose 36 can transfer liquid from a liquid source (not shown) through the adapter piece opening 34 to the plastic tank 12. A pinch clamp 39, shown in FIG. 1, is utilized to selectively clamp the hose 36 shut. A cylindrical gasket 38 positioned between the outer rim or edge of the outwardly projecting receiving inlet 18 and an opposing facing surface about the outer circumference of the adapter piece 32 provides a seal between the receiving inlet and the adapter piece.

The portable suction device 10 also includes first and second support means for supporting an apparatus on the plastic tank 12. More specifically, the first support means can be a plastic support bracket 40. The support bracket 40 includes a protrusion receiving fitting 42 adapted to receive the protrusion 24 of the plastic tank 12. As shown in FIG. 2, a portion of the protrusion receiving fitting 42 can be fitted under part of the protrusion 24. Further, a slotted arrangement or a variety of shapes for interlocking the protrusion receiving fitting 42 and the protrusion 24 are possible. For example, the protrusion receiving fitting 42 can be snap fit into the protrusion 24. Other securement arrangements such as adhesives, screws, bolts or the like can also provide the same function as the protrusion 24 and the fitting 42, but are less preferable.

The support bracket 40 further includes a tube receiving ring-shaped flange 44. The tube receiving flange 44 preferably has a cylindrical cup-shape that defines a central axis and includes a shoulder 46 which projects inwardly toward the axis and defines a centrally oriented and sidewardly opening aperture 48.

The protrusion receiving fitting 42 and the tube receiving flange 44 preferably are both integral sections of the support bracket 40.

The second support means can be formed by an internally threaded plastic pump mounting cap 50 which threadably connects to the cylindrical pump outlet 22 of the plastic tank 12. The pump mounting cap 50 includes a ring-shaped shoulder or flange 52 extending circumferentially at one end of the pump mounting cap 50. The orifice defined through the pump mounting cap 50 is substantially coaxially aligned with the pump aperture 20 to enable passage of fluid therethrough.

The plastic support bracket 40 and the pump mounting cap 50, in combination, support a pump apparatus 60. The pump apparatus 60 includes an elongate cylindrical tube 62, which in the illustrated embodiment is made of metal. The tube receiving flange 44 of the plastic support bracket 40 receives a first end 64 of the cylindrical tube 62. The tube receiving flange 44 of the support bracket 40 prevents movement of the cylindrical tube 62 upwardly or downwardly at the first end 64 in any direction perpendicular to longitudinal axis 66 of the cylindrical tube. The first end 64 of the cylindrical tube rests or abuts against shoulder 46 of the support bracket 40, which prevents movement along the longitudinal axis 66 of the cylindrical tube 62.

When the plastic tank 12 is placed on a level surface, the longitudinal axis 66 of the cylindrical tube 62 is substantially horizontal in orientation to the ground or lower plane of the tank defined by the bottom surfaces of legs 14. In this arrangement, the portable suction device 10 can easily be carried.

A second end 68 of the cylindrical tube 62 is received within the pump mounting cap 50 and the pump outlet 22. More specifically, the second end 68 of the tube 62 extends inside the interior edge of the cylindrical shoulder 52 of the pump mounting cap 50 and into the pump aperture 20 of the cylindrical pump outlet 22.

Figure 3:
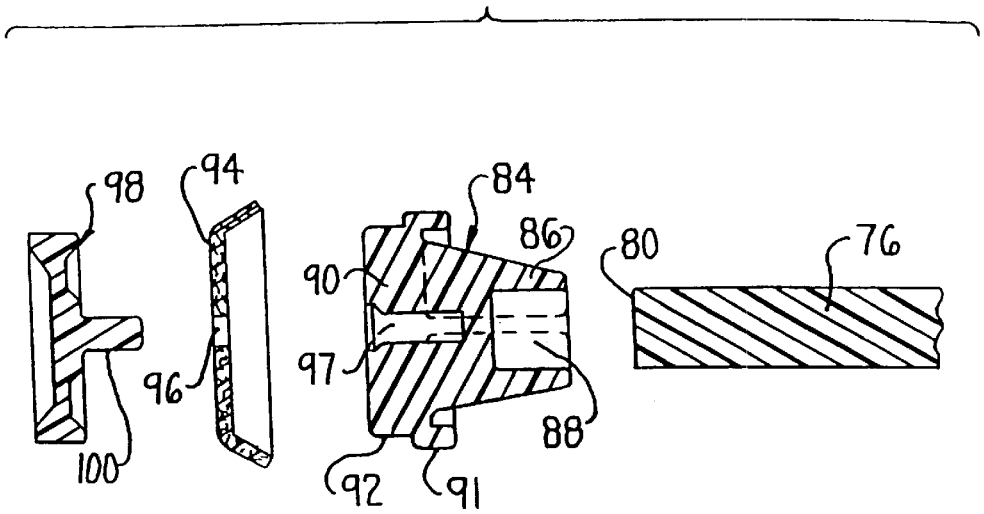
FIG. 3 is an enlarged exploded view of the pump apparatus of the invention shown in FIG. 2.

The pump apparatus 60 includes a metal closure element 70 that overlies a portion of the cylindrical tube 62 at the second end 68. The metal closure element 70 has a cylindrical cup shape and includes an outwardly projecting flange portion 72 (as best illustrated in FIG. 3) ending at an upwardly projecting flange portion 73 at the innermost end of the closure element.

Figure 4:
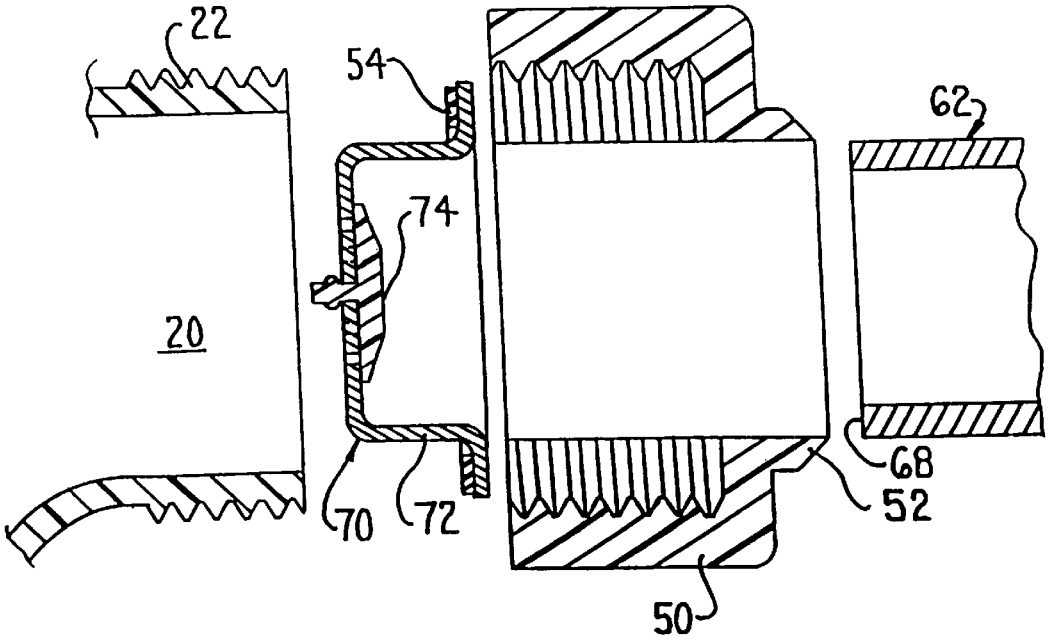
FIG. 4 is an enlarged exploded view of the pump mounting cap and its relationship with the metal closure element and the pump outlet of the plastic tank shown in FIG. 2.

The pump mounting cap 50 receives the closure element 70. The metal closure element 70 is then swaged to the pump mounting cap 50. The projecting pump mounting cap 50 (which also has already been mounted on end 68 of tube 62) then is threadably secured to the pump outlet 22. A gasket 54, shown in FIG. 4, is located at a surface about the outer circumference of the flange portion 73 for contacting an opposing surface about the circumference of the pump outlet 22.

The metal closure element 70 includes a check valve 74 enabling gas to pass from the interior of the plastic tank 12 and into the cylindrical tube 62. Check valve 74 can comprise a rubber flap biased into the closed position, but capable of movement inwardly toward the interior of the cylindrical tube 62.

The cylindrical tube 62 of the pump apparatus 60 acts as a housing for the other elements thereof and supports the pump apparatus on the plastic tank 12.

The pump apparatus 60 includes a piston rod 76 having a first end 78 and a second opposing end 80. The first end 78 of the piston rod 76 is secured to a pump handle 82. The pump handle 82 can have an aperture receiving an end of the piston rod 76 or be otherwise attached thereto. The pump handle 82 can also be an integral part of the piston rod 76.

The second end 80 of the piston rod 76 is secured to a piston 84 as shown in FIGS. 2 and 3. The piston 84 preferably has a projection 86 projecting outwardly from the piston and having a central opening 88 to receive the piston rod 76. The piston 84 includes an opposing flat end surface 90, as well as an upwardly projecting cylindrical flange portion 91 projecting upwardly from a peripheral edge 92 between the projection 86 and the end surface 90. The piston 84 has a cylindrical shape about the peripheral edge 92 and along an outer edge of the flange portion 91.

While the second end 80 of the piston rod 76 preferably is push fit into the opening 88 of the projection 86 of the piston 84, other known fastening arrangements can be utilized. Of course, the piston 84 is received inside of the cylindrical tube 62 along with the piston rod 76. As shown in FIG. 3, the pump apparatus 60 further includes a piston valve member 94 extending about the peripheral edge 92 of the piston 84. The piston valve member 94 can be a leather element soaked in oil, preferably for 24 hours, before mounting onto the piston 84. The piston valve member 94 can also be a rubber disk 94 having a cup shape so that part of the disc extends over at least a portion of the peripheral edge 92 of the piston. The outer cylindrical portion of the piston valve member 94 can ensure a tight seal between the inner wall of the cylindrical tube 62 and the piston 84 when the piston rod 76 is moved in a direction of withdrawal from the tube. When the piston 84 is moved inwardly, however, the rubber disc or leather element 94 can ensure leakage of fluid thereabout.

Another portion of the piston valve member 94 preferably extends over the flat end surface 90 of the piston 84. This portion of the piston valve member 94 includes a piston valve aperture 96 for accessing an opening or closed aperture 97 in the piston 84.

A piston end piece 98 includes an extension 100 for insertion through the piston valve aperture 96 and into the opening 97 of the piston 84. The piston end piece 98 thus secures the piston valve member 94 to the piston 84 and ensures proper positioning of the piston valve member.

The piston rod 76 is preferably metal. The piston 84 and the piston end piece 98 are preferably are made from a plastic material, such as a polypropylene copolymer, a polyethylene or other plastic having similar properties.

Safest operation of the portable suction device 10 is obtained by constructing the piston 84 of plastic material and the cylindrical tube 62 of a metal material. This arrangement functions well in use because the large metal surface area of the metal tube 62, as well as the varying conductivity of material, among the piston, tube and tank dissipates static charge. A plastic tube, in combination with a plastic piston and plastic piston rod may create more static charge than the above arrangement. Therefore, the combination of metal and plastic elements, as disclosed herein, provides the optimum result and safety.

The horizontal orientation of the pump apparatus 60 and the concave depression 26 in the plastic tank 12, in combination, form a handle arrangement for the portable suction device 10. This arrangement provides advantages to a user. First, the depression 26 enables easy placement of the hand of the user about the cylindrical tube 62 acting as a portable suction device handle. By the additional use of the cylindrical tube 62 of the pump apparatus 60 as part of the suction device handle, the dimensions of the portable suction device 10 can be reduced without decreasing the capacity of the plastic tank. Therefore, the suction device 10 stores more easily and in smaller areas than known suction devices. The shape, size and portability of the suction device 10 is especially valuable for use with marine engines where the engine is not as easily accessible as, for example, an automotive engine in an automobile repair bay.

Another benefit is that there is no need to remove an external pump from the portable suction device 10 for storage thereof. Some other pump storage devices require such removal.

The portable suction device 10 can be used to pump fuel, transmission oil or engine oil from an engine. In this regard, so as not to encourage purchasers to utilize the same suction device 10 to pump fuel, transmission oil, engine oil or the like, the device can be packaged for use with gasoline, such as by labeling same as a gasoline pump unit and providing same with an exterior color such as red. The same portable suction device 10 can then also be packaged for use strictly with oil, by labeling same as an oil pump unit and providing same with a different color from the gasoline pump unit, such as blue.

OPERATION

The user first decides if diesel fuel, gasoline, or engine oil is going to be removed from an engine. Depending on which type of liquid will be removed, a portable suction device 10 having an appropriate color will be selected at the purchase location as discussed above. For example, red generally is associated with gasoline and can be used with a suction device 10 for removing gasoline. Other colors are then used to identify the other types of liquids being extracted.

After selecting a color coded portable suction device 10, the user then secures, if not already secured, a first end of the hose 36 to the adapter piece 32 adjacent the receiving aperture 16 of the plastic tank 12. Then, the second end of the hose 36 is placed into a fuel tank or oil crankcase to remove the liquid therein.

The user utilizes the pinch clamp 39 to shutoff fluid intake into the plastic tank 12 through the hose 36.

The user then operates pump apparatus 60 to remove gas or air from the interior of plastic tank 12, thus creating a negative pressure therein. The operation starts with the piston rod 76 in a first position extending as far as possible into the cylindrical tube 62 with the pump handle 82 as close as possible to the first end 64 of the tube. The user then moves the pump handle 82 away from the cylindrical tube 62 in an outward stroke thus causing the piston 84 to move along the longitudinal axis 66 of the cylindrical tube 62 toward the first end 64 thereof. During movement along this path, check valve 74 opens enabling air or gas to pass from plastic tank 12 into the cylindrical tube.

The user then pushes the pump handle 82 toward the cylindrical tube 62 in an inward stroke, thus moving the piston 84 back toward the second end 68 of the tube. The check valve 74 only enables travel of air or gases out of the plastic tank 12. Therefore, during the return travel path of the piston 84, the flap of the check valve 74 closes and air in the cylindrical tube 62 leaks between the inner circumference of the cylindrical tube and the outer circumference of the piston valve member 94 adjacent the cylindrical tube. This is so because, when the piston is moved inwardly, the outer cylindrical portion of the piston valve member 94 pushes downwardly due to the force of air compressed in the cylindrical tube 62. This permits fluid to leak about an edge at the outer circumference of the piston valve member 94, thus preparing the pump apparatus 60 for extraction of more gases or air. The air then exits the cylindrical tube 62 at the aperture 48 that receives piston rod 76.

However, on the outward stroke, the piston valve member 94 opens outwardly in an umbrella effect, or folds outwardly, thus providing a tight seal with the cylindrical tube 62. The user repeats the strokes of this operation until the air or gas is sufficiently evacuated from the plastic tank 12 and the negative pressure in the tank reaches an acceptable value.

After the desired negative pressure is achieved, the user can release the pinch clamp 39 and draw the flow of liquid from the engine into the plastic tank 12. The operator can continue to stroke the pump apparatus 60 until substantially all of the liquid is withdrawn.

In conclusion, operation of the above device provides a convenient way to remove liquid from an engine. More significantly, the size and shape of the portable suction device 10, and especially the suction device handle arrangement, enables convenient storage and improved utility for the device.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A portable suction device comprising:

a plastic tank including a pump aperture for enabling removal of gas from said tank and a receiving aperture for receiving a liquid or gas from an engine;

a pump apparatus for creating a negative pressure in the plastic tank;

first and second support means securing said pump apparatus to said tank so that said pump apparatus functions as a portable suction device handle for carrying the plastic tank;

wherein said pump apparatus comprises:

an elongate cylindrical tube secured to said support means;

a piston surrounded by said cylindrical tube;

a piston rod having a first end extending outwardly beyond a first end of said cylindrical tube, said piston rod secured at a second end to said piston;

a piston valve member extending about at least a portion of a peripheral edge of the piston; and a pump handle at the first end of said piston rod for enabling movement of said piston rod along a length of said cylindrical tube;

wherein a longitudinal axis of said cylindrical tube of said pump apparatus is at a substantially horizontal orientation when said portable suction device is placed on a level surface.

2. The portable suction device of claim 1, wherein said pump apparatus further comprises a metal closure element including a check valve to enable creation of the negative pressure.

3. The portable suction device of claim 2, said plastic tank including an integral protrusion extending substantially upwardly therefrom, and wherein said first support means comprises a plastic support bracket for supporting the first end of said cylindrical tube adjacent the handle, said plastic support bracket mounting to the protrusion of said plastic tank;

said second support means comprises a plastic pump mounting cap for receiving the second end of said cylindrical tube, said plastic pump mounting cap capable of securement to the pump aperture of said tank, said pump mounting cap securing said metal closure element between an end face about the pump aperture of said plastic tank and an inward face of said plastic pump mounting cap, and wherein said cylindrical tube of said pump apparatus functions as a portable suction device handle for carrying the plastic tank.

4. The portable suction device of claim 3, wherein said plastic support bracket includes a cylindrical cup- shape for receiving and supporting the first end of said cylindrical tube and an aperture along a central axis for enabling travel of said piston rod therethrough.

5. The portable suction device of claim 3, further comprising:

a receiving cap having a cap opening, said receiving cap capable of securement to said plastic tank at the receiving aperture thereof;

a hose for securement at one end at the cap opening of said receiving cap, the other end of said hose for placement in a liquid source to be drained from the engine, and a pinch clamp for clamping said hose to enable creation of a negative pressure in said plastic tank before release of said pinch clamp and withdrawal of liquid by a user.

6. The portable suction device of claim 5, wherein the color of said tank is selecting dependent on whether the liquid being removed comprises oil, diesel fuel or gasoline.

7. The portable suction device of claim 1, wherein said plastic tank includes four integrally formed plastic legs, said tank comprising a polyethylene material having a sufficient thickness to prevent collapse due to the negative pressure.

8. The portable suction device of claim 1, wherein said piston valve member comprises a leather element soaked in oil and extending about at least a portion of a flat surface of the piston as well as a portion of the peripheral edge of the piston.

9. The portable suction device of claim 1, said pump apparatus including a piston end piece having an extension for securing said piston valve member to said piston.

10. The portable suction device of claim 9, wherein said piston rod comprises a metal, and said piston and said piston end piece comprise plastic material.

11. The portable suction device of claim 9, wherein said piston valve member comprises a leather element soaked in oil and extending about at least a portion of an outer flat surface of the piston as well as the peripheral edge of the piston, said disk including an aperture to enable the extension of said piston end piece to pass therethrough and secure said disk to said piston.

12. The portable suction device of claim 9, wherein said piston comprises a plastic piston and said cylindrical tube comprises a cylindrical metal tube having a large metal surface area to decrease the static charge between the piston, the cylindrical metal tube and the tank.

13. A portable suction device for removing liquid from an engine comprising:

a plastic tank including a pump aperture for enabling removal of gas from said tank and a receiving aperture for receiving a liquid or gas from an engine, the plastic tank having an integral protrusion extending substantially upwardly therefrom;

a pump apparatus for creating a negative pressure in the plastic tank comprising:

a cylindrical tube;

a piston surrounded by said cylindrical tube;

a piston rod having a first end extending outwardly beyond a first end of said cylindrical tube, and a second end secured to said piston; and a pump handle at the first end of said piston rod for enabling movement of said piston rod along a length of said cylindrical tube;

a plastic support bracket for mounting to the protrusion of said tank and supporting the first end of the cylindrical tube adjacent the pump handle;

a pump support cap for receiving the second end of said cylindrical tube, said pump support cap capable of securement about the pump aperture of said plastic tank; and a metal closure element between an inward face of said pump support cap and an end face of said plastic tank about the pump aperture for substantially closing the pump aperture, wherein said plastic support bracket and said pump support cap secure said cylindrical tube of said pump apparatus to said tank so that said cylindrical tube of said pump apparatus functions as a portable suction device handle for carrying the plastic tank.

14. The portable suction device of claim 13, including a check valve supported by said metal closure element to enable said pump apparatus to remove gas from said tank and create the negative pressure.

15. The portable suction device of claim 13, wherein said plastic support bracket includes a cylindrical cup-shape for receiving and supporting the first end of said cylindrical tube and an aperture along a central axis for enabling travel of said piston rod therethrough.

16. The portable suction device of claim 13, wherein said piston comprises a plastic piston and said cylindrical tube comprises a cylindrical metal tube having a large metal surface area to decrease the static charge between said piston, said metal tube and said plastic tank.

17. The portable suction device of claim 13, said piston apparatus further comprising a piston valve member comprising a leather element soaked in oil and extending about at least a portion of a substantially flat end surface of the piston as well as a peripheral edge of the piston.

18. The portable suction device of claim 17, said pump apparatus including a piston end piece having an extension for projecting through an aperture in said leather element to secure said leather element to said piston.

19. The portable suction device of claim 18, wherein said piston rod comprises a metal material, and said piston and said piston end piece comprise a plastic material.

20. The portable suction device of claim 13, further comprising:

a receiving cap having a cap opening, said receiving cap being capable of securement to said plastic tank opening at the receiving aperture thereof;

a hose for securement at one end to the cap opening of said receiving cap, the other end of said hose for placement in a fluid source to be drained, and a pinch clamp for clamping said hose to enable creation of a negative pressure in said plastic tank before release of said pinch clamp and withdrawal of liquid by a user.

* * * * *